US007528316B2

(12) United States Patent
Isozaki

(10) Patent No.: US 7,528,316 B2
(45) Date of Patent: May 5, 2009

(54) MUSICAL SOUND GENERATING VEHICULAR APPARATUS, MUSICAL SOUND GENERATING METHOD AND PROGRAM

(75) Inventor: Yoshimasa Isozaki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/950,033

(22) Filed: Dec. 4, 2007

(65) Prior Publication Data

US 2008/0163745 A1 Jul. 10, 2008

(30) Foreign Application Priority Data

Dec. 6, 2006 (JP) ..... 2006-329490
Feb. 16, 2007 (JP) ..... 2007-036673

(51) Int. Cl.
*G10H 7/00* (2006.01)
*G10H 1/40* (2006.01)

(52) U.S. Cl. ..... 84/612; 84/611

(58) Field of Classification Search ..... 84/602, 84/611, 612

See application file for complete search history.

(56) References Cited

U.S. PATENT DOCUMENTS 4,995,294 A 2/1991 Kashio et al.
5,062,341 A 11/1991 Reiling et al.
5,157,614 A 10/1992 Kashiwazaki et al.
5,192,823 A 3/1993 Suzuki et al.
5,557,683 A 9/1996 Eubanks
5,633,985 A 5/1997 Severson et al.
5,885,085 A 3/1999 Fujita
RE36,387 E 11/1999 Rosenberg et al.
6,230,140 B1 5/2001 Severson et al.
6,838,610 B2 1/2005 de Moraes
7,053,288 B2 5/2006 Iwai et al.

(Continued)

FOREIGN PATENT DOCUMENTS

EP 1562176 A1 8/2005

(Continued)

OTHER PUBLICATIONS

Partial European search report, mailed Apr. 14, 2008, issued in corresponding EP patent application No. 07023346.5-2225.

(Continued)

*Primary Examiner*—Jeffrey Donels
(74) *Attorney, Agent, or Firm*—Rossi, Kimms & McDowell LLP

(57) ABSTRACT

In order to provide a musical sound generating vehicular apparatus and a program of the same for playing musical sounds based on a status of a vehicle without depending on parameter changes such as volume of the musical sound, a vehicle status detection means (11) which detects a control status of the vehicle, a storage means (13) which stores musical sound data, a musical sound data playback means (3) which plays the musical sound based on the musical sound data stored in the storage means (13), and a control means (1) which determines a playback interval of the musical sound data stored in the storage means (13) based on the control status of the vehicle detected by the vehicle status detection means (11) and controls the musical sound playback means (3) to play the playback interval of the musical sound data are provided.

10 Claims, 9 Drawing Sheets

U.S. PATENT DOCUMENTS

| | | | | |
|---|---|---|---|---|
| 7,053,289 | B2 * | 5/2006 | Iwai et al. | 84/600 |
| 7,317,158 | B2 * | 1/2008 | Yamamoto | 84/612 |
| 2003/0079600 | A1 | 5/2003 | De Moraes | |
| 2004/0244568 | A1 | 12/2004 | Nakabo et al. | |
| 2005/0172788 | A1 | 8/2005 | Yamamoto | |
| 2005/0188821 | A1 | 9/2005 | Yamashita et al. | |
| 2006/0052167 | A1 | 3/2006 | Boddicker et al. | |
| 2007/0234888 | A1 | 10/2007 | De Moraes | |

FOREIGN PATENT DOCUMENTS

| | | | |
|---|---|---|---|
| JP | 8248953 | A | 9/1996 |
| JP | 9292247 | A | 11/1997 |
| JP | 2001-189969 | A | 7/2001 |
| JP | 2002-114107 | A | 4/2002 |
| JP | 2003-150176 | A | 5/2003 |
| JP | 2003-309891 | A | 10/2003 |
| JP | 2004-051081 | A | 2/2004 |

OTHER PUBLICATIONS

Partial European Search Report issued in EP 07023425.7-2225, dated Mar. 25, 2008, which corresponds to related co-pending U.S. Appl. No. 11/950,059.

Specification, drawings and preliminary amendment of unpublished related co-pending U.S. Appl. No. 11/950,059, filed Dec. 4, 2007. "Onboard Music Reproduction Apparatus and Music Information Distribution System"; Yoshimasa Isozaki et al.; 97 pages.

Extended search report issued in corresponding European application No. 07023346.5-2225, dated Jun. 4, 2008.

* cited by examiner

FIG. 3

RELATION TABLE

| SAMPLING POINT | MARKER | VEHICLE STATUS |
|---|---|---|
| 0～100 | 21 | IDLING |
| 120～150 | 22 | START |
| 160～250 | 28 | RUNNING AT UNIFORM SPEED |
| 260～310 | 23 | ACCELERATION 1 |
| 350～400 | 24 | ACCELERATION 2 |
| 440～500 | 25 | DECELERATION 1 |
| 520～600 | 26 | DECELERATION 2 |
| 620～690 | 27 | STOP |
| 390 | 32 | RUNNING AT UNIFORM SPEED |

FIG. 8

101

MIDTOWN

MOUNTAIN AREA

| SEA SIDE | FINE | CLOUDED | RAINY |
|---|---|---|---|
| AM | PITCH 2<br>VOLUME 2<br>TEMPO 3<br>TIMBRE 2 | --- | --- |
| PM | --- | --- | --- |

FIG. 9

102

| DRIVING CONDITION | PITCH | VOLUME | TEMPO | TIMBRE |
|---|---|---|---|---|
| IDLING | 1 | 2 | 1 | 2 |
| START | 2 | 2 | 2 | 2 |
| RUNNING AT UNIFORM SPEED | : | : | : | : |
| ACCELERATION | : | : | : | : |
| DECELERATION | : | : | : | : |
| ⋮ | | | | |
| STOP | : | : | : | : |

MUSICAL SOUND GENERATING VEHICULAR APPARATUS, MUSICAL SOUND GENERATING METHOD AND PROGRAM

BACKGROUND OF THE INVENTION

1. Field of the Invention

The present invention relates to a musical sound generating vehicular apparatus, a musical sound generating method and a program.

Priority is claimed on Japanese Patent Application No. 2006-329490, filed Dec. 6, 2006 and Japanese Patent Application No. 2007-036673, filed Feb. 16, 2007, the content of which is incorporated herein by reference.

2. Description of the Related Art

Generally speaking, sounds generated by a vehicle such as an automobile and heard by a passenger and the like include: sounds of machines generated by a mechanical portion such as an engine of the vehicle; an alarm sound which is raised if the vehicle is speeding over a predetermined speed; a sound of a winker when the vehicle turns right or left; an alarm sound which is generated when something is close to the vehicle and there is a possibility to of a collision; and the like. Moreover, audio devices are generally used by a passenger, and the like for listening to a music CD (Compact Disc) and a radio program.

However, conventional audio devices, for example, playback a music CD and output radio sounds regardless of a state of the vehicle, an operational state of a driver, and the like. Therefore, with regard to a function such as playing a music CD, there is no difference from listening to music at home, and it was not possible to provide entertainment by playing music which is especially distinctive or appropriate to a status of the vehicle.

In other words, in the past, there has been no system which integrally indicates a general status of the vehicle by generating sounds, and a driver of the conventional vehicle controls the vehicle based on eyesight, sounds of the machine generated by the mechanical portions of the vehicle and alarm sounds.

With regard to such a background, there is a disclosure of prior art for controlling sounds based on a driving status of an automobile, that is, a conventional technique which controls a volume of sounds, and the like generated by an audio device in accordance with a revolution of an engine (see Patent Document 1).

Patent Document 1: Japanese Patent Application, First Publication No. 2003-309891

By applying the above-described prior art, it is possible to change the volume of sounds, and the like generated by the audio device based on a rotation of the engine. However, even by using the above-described prior art, it is not possible to generate different musical sounds in accordance with the status of the vehicle. Therefore, there is a problem in which it is not possible to play musical sounds in accordance with the status of the vehicle in order to provide entertainment for a driver and/or a passenger.

SUMMARY OF THE INVENTION

The present invention was conceived with regard to the above-described backgrounds, and has an object to provide a musical sound generating apparatus and a program which can change the musical sounds appropriate to the status of a vehicle. Such a change of the musical sounds is not an adjustment of a parameter such as volume of sounds which is described in the above-described prior art.

Moreover, the present invention has another object to provide a musical sound generating vehicular apparatus and a musical sound generating method which can change the musical sounds in accordance with the driving status based on the musical sounds selected beforehand in correspondence with the driving status of the vehicle.

The present invention was conceived in order to solve the above-described problems and for example, provides the following solutions.

A first solution is a musical sound generating vehicular apparatus including: a vehicle status detection unit detecting a control status of a vehicle; a storage unit storing musical sound data; a musical sound playback unit playing the musical sound data stored in the storage unit; and a control unit which determines playback interval of the musical sound data stored in the storage unit in accordance with the control status of the vehicle and controls the musical sound playback unit in order to play the determined playback interval of the musical sound data.

In accordance with the above-described solution, the vehicle status is determined based on the control status of the vehicle, the playback interval is determined based on the vehicle status, and the determined playback interval of the musical sound data is played. Therefore, it is possible to play the musical sound which is changed based on the vehicle status.

Moreover, preferably, a second solution is the above-described musical sound generating vehicular apparatus, wherein the control unit selects the musical sound data to be played by the musical sound playback unit from the storage unit based on the control status of the vehicle.

In accordance with the above-described solution, the musical sound data is played based on the control status of the vehicle. Therefore, it is possible to play the musical sound which is appropriate to the vehicle status.

Moreover, preferably, a third solution is the above-described musical sound generating vehicular apparatus, further including an environmental condition detection unit detecting environmental condition of the vehicle, wherein the control unit selects the musical sound data to be played by the musical sound playback unit from the storage unit based on the control status or the environmental condition of the vehicle.

In accordance with the above-described solution, the musical sound data is played based on the environmental condition or the control status of the vehicle. Therefore, it is possible to play the musical sound which is appropriate to the vehicle status.

Moreover, preferably, a fourth solution is the above-described musical sound generating vehicular apparatus according to claim 1, wherein if the control status of the vehicle has not been changed for a predetermined time, the control unit controls the musical sound playback unit to repeat the determined playback interval of the musical sound data for the predetermined time.

In accordance with the above-described solution, the determined playback interval of the musical sound data is repeated if the control status of the vehicle is not changed, that is, the vehicle status is not changed. Therefore, the musical sound is automatically changed even if the vehicle status is not changed, and it is possible for the driver and the passengers to listen to the musical sound without being bored.

Moreover, preferably, a fifth solution is the above-described musical sound generating vehicular apparatus, wherein if the control status of the vehicle has not been changed after a predetermined time, the control unit selects another playback interval of the musical sound data and controls the musical sound playback unit to repeat the other playback interval of the musical sound data.

Moreover, in order to solve the above-described problems, the present invention provides, for example, the following solutions.

A sixth solution is preferably the above-described musical sound generating vehicular apparatus, wherein the musical sound data includes a predetermined musical element parameter, the musical sound generating vehicular apparatus further including: a playback position detection unit which determines a plurality of playback intervals included in the musical sound data based on the predetermined musical element parameter of the musical sound data; an analysis unit which analyzes and stores the predetermined musical element parameter of the playback interval in the storage unit together with a connection relationship with regard to the musical sound data; and a playback rule data storage unit which stores the musical element parameter of the musical sound to be played together with a corresponding driving status of the vehicle, wherein the control unit obtains the musical element parameter corresponding to the driving status of the vehicle detected by the vehicle status detection unit in reference to the playback rule data storage unit, determines the playback interval of the musical sound data which satisfies conditions of the obtained musical element parameter, and controls the musical sound data playback portion to play the determined playback interval of the musical sound data.

In accordance with the sixth solution, the musical sound data is divided into multiple phrases (playback intervals) by analyzing musical element parameters of the musical sound data, characteristics of the phrases are obtained and stored by analyzing the musical element parameter of the divided phrases, and the phrase is selected and played which is appropriate to the detected driving status of the vehicle. Therefore, in accordance with the above-described solution, it is possible to change the musical sound in accordance with the driving status of the vehicle, that is, it is possible to automatically change the musical sound. Moreover, in accordance with the above-described solution, it is possible to obtain an advantageous point in which it is not necessary to generate or provide the musical sound data to be played beforehand, and it is possible to automatically play the musical sound in accordance with the driving status of the vehicle by using the musical sound data which the user already has.

A seventh solution is preferably the above-described musical sound generating vehicular apparatus, further including an environmental condition detection unit which detects environmental condition of the vehicle, wherein the control unit selects the musical sound data to be played by the musical sound playback unit from the storage unit based on the environmental condition of the vehicle detected by the environmental condition detection unit.

An eighth solution is preferably the above-described musical sound generating vehicular apparatus, wherein the musical element parameter is one of or a combination of pitch, volume, tempo and timbre.

A ninth solution is preferably a musical sound generating vehicular method including the steps of: detecting a status of a vehicle; selecting a playback interval of musical sound data stored in a storage unit based on the detected status of the vehicle; and playing the selected playback interval of the musical sound data stored in the storage unit.

In accordance with the above-described ninth solution, the phrase is selected and played which is appropriate to the detected driving status of the vehicle. Therefore, in accordance with the above-described solution, it is possible to change the musical sound in accordance with the driving status of the vehicle, that is, it is possible to automatically change the musical sound.

A ninth solution is preferably a computer program stored on a computer readable medium, the computer program executable to generate sound, the computer program including computer executable instructions for: detecting a status of a vehicle; selecting a playback interval of musical sound data stored in a storage unit based on the detected status of the vehicle; and playing the selected playback interval of the musical sound data stored in the storage unit.

In accordance with the above-described solutions, the playback interval of the musical sound data is determined based on the vehicle status. Therefore, it is possible to provide the musical sound generating vehicular apparatus and the program which can change the musical sound to be played based on the vehicular status without depending on changes of parameters of the musical sound even though only one musical sound data is used.

BRIEF DESCRIPTION OF THE DRAWINGS

FIG. 3 is a relationship table which indicates the relationship between a position of the marker set inside the musical sound data of the above-described musical sound generating vehicular apparatus and status of the vehicle.

FIG. 8 is a drawing for explaining a table constitution of a playback rule base shown in FIG. 5.

FIG. 9 is a drawing for explaining a table constitution of a playback rule base shown in FIG. 5.

DETAILED DESCRIPTION OF THE INVENTION

Hereinafter, the following embodiments with regard to the present invention are explained in reference to drawings.

First Embodiment

Figure 1:
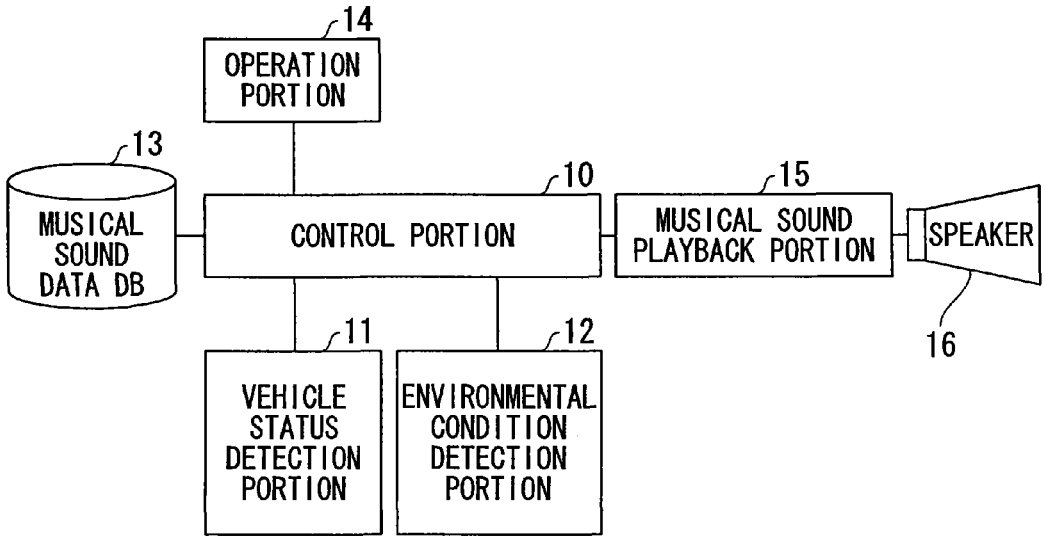
FIG. 1 is a block diagram of a musical sound generating vehicular apparatus of a first embodiment.

FIG. 1 is a block diagram of a musical sound generating vehicular apparatus of a first embodiment. It should be noted that, in the following explanations, the same reference numeral is assigned to two or more constitutional elements if they are the same or similar.

In FIG. 1, a reference numeral 1 is a control portion, 11 is a vehicle status detection portion, 12 is an environmental condition detection portion, 13 is a musical sound data DB (Data Base), 14 is an operation portion, 3 is a musical sound playback portion and 4 is a speaker.

The control portion 1 is connected to and controls the vehicle status detection portion 11, the environmental condition detection portion 12, the musical sound data DB 13, the operation portion 14 and the musical sound playback portion 3.

The vehicle status detection portion 11 detects the control status of a vehicle (speed of the vehicle, a revolution of an engine, a degree of opening of an acceleration pedal, an operational status of a brake pedal, an operational status of a shift lever, and the like), and is constituted from, for example, a sensor.

The environmental condition detection portion 12 detects environmental conditions around the vehicle (a position of the vehicle, time, weather, and the like). The environmental condition detection portion 12 is constituted from, for example, a GPS (Global Positioning System), a timer, a sensor, and the like.

The operation portion 14 is used for, for example, setting the musical sound data and the musical sound generating vehicular apparatus. Moreover, the musical sound playback portion 3 plays back musical sounds based on the musical sound data. Moreover, the speaker 4 is connected to the musical sound playback portion 3 and outputs the musical sounds as the sound.

Furthermore, the musical sound data DB 13 stores multiple files or sets of the musical sound data, and it is possible to set a marker to the stored musical sound data in order to indicate a playback interval which is an interval of the musical sound data to be played. The musical sound data DB 13 has a function of a storing unit of this embodiment.

Next, one example of the musical sound data and the marker stored in the musical sound data DB 13 is explained.

Figure 2:
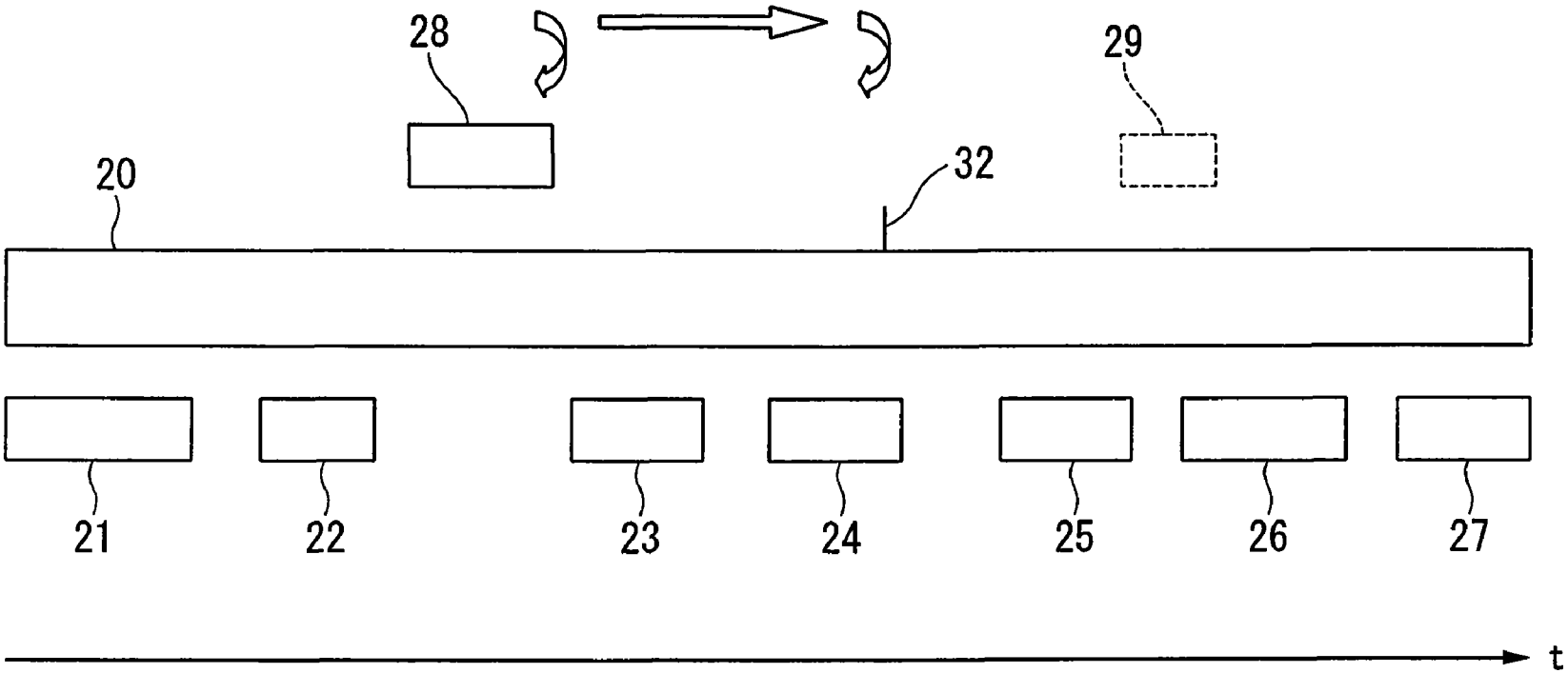
FIG. 2 is a drawing for explaining a marker which is set to musical sound data of the above-described musical sound generating vehicular apparatus.

FIG. 2 is a drawing for explaining the marker which is set to the musical sound data.

In FIG. 2, 20 is musical sound data, 21 is a marker (idling), 22 is a marker (start), 23 is a marker (acceleration 1), 24 is a marker (acceleration 2), 25 is a marker (deceleration 1), 26 is a marker (deceleration 2), 27 is a marker (stop), 28 is a marker (driving at a uniform speed) and 32 is a repeat marker.

These markers 21-28 and the repeat marker 32 indicate a playback interval of the musical sound data 20.

The musical sound data 20 is musical sound data sold on the market such as a music CD or musical data which is generated by combining various phrases and which is dedicated to the musical sound generation vehicular apparatus. Data format of the musical sound data 20 can be, for example, sequence data of MIDI (Musical Instrument Digital Interface) format or audio data.

Moreover, in FIG. 2, a horizontal axis indicates a time axis. The markers 21-28 are respectively set to predetermined data included in the musical sound data 20 in correspondence with the status of the vehicle (idling, start, acceleration 1, acceleration 2, deceleration 1, deceleration 2, stop, driving at a uniform speed). Moreover, the markers 21-28 are set beforehand to time or sampling points corresponding to the musical sound data 20. In this embodiment, an example is explained in which the markers are set to the sampling points.

It should be noted that it is possible to apply a constitution in which a user can add the markers, change the position of the markers, and the like by using the operation portion 14.

The repeat marker 32 is set at any positions after a position of the marker 28 and indicates a playback interval that is repeated.

The musical sound data DB 13 stores a relationship table which indicates a relationship between status of the vehicle and positions inside the musical sound data at which the markers 21-28 and the repeat marker 32 are set. FIG. 3 shows the relationship table. As shown in FIG. 3, with regard to each of the markers, the relationship table stores a correspondence relationship between a sampling point of the musical sound data to which the marker is set and status of the vehicle.

The relationship table is set at a header portion of the musical sound data, or the like. It should be noted that it is possible to store the relationship table in a memory or storage which is included in the control portion 1 and which is not shown in the drawings.

Figure 4:
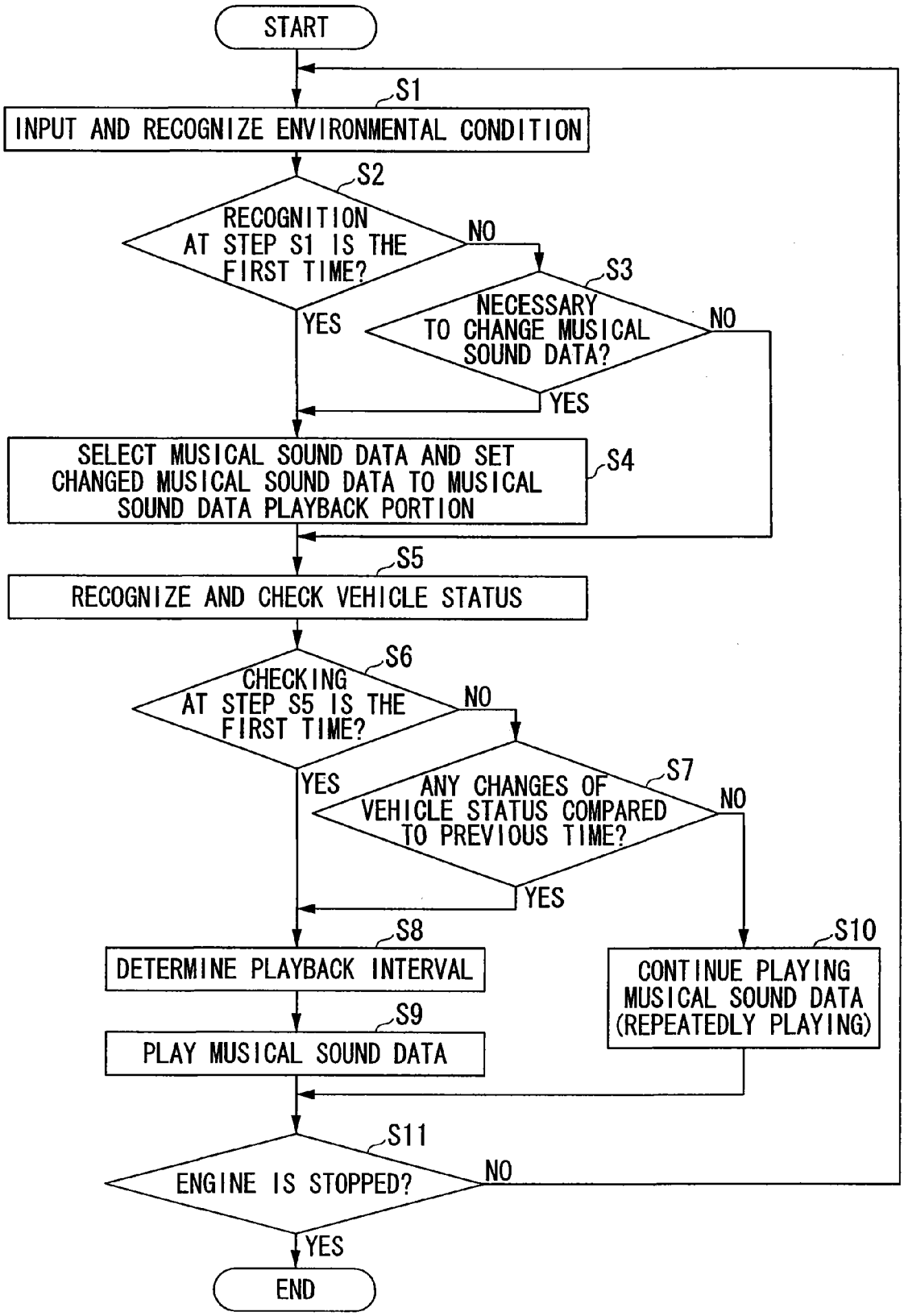
FIG. 4 is a flowchart which shows operations of the above-described musical sound generating vehicular apparatus.

Next, in reference to a flowchart shown in FIG. 4, operations of the musical sound generating vehicular apparatus of the first embodiment are explained.

First, the environmental condition detection portion detects environmental conditions (position of the vehicle, time, weather, and the like) of the vehicle when an engine of the vehicle is started. The control portion 1 inputs and recognizes the detection results (Step S1).

Next, the control portion 1 detects whether or not the detection result of the environmental condition obtained at Step S1 is the first time (Step S2). If the environmental condition obtained at Step S1 was not the first time (Step S2: "No"), the control portion 1 determines whether or not it is necessary to change the musical sound data because there is a change in the environmental conditions compared to the previously detected results (Step S3).

If the control portion 1 detects that the environmental condition obtained at Step S1 was the first time (Step S2: "Yes") or it is necessary to change the musical sound data because there is a change in the environmental conditions compared to the previously detected results (Step S3: "Yes"), the control portion 1 selects the appropriate musical sound data from the musical sound data DB 13 based on the detected environmental conditions of the vehicle, sets the changed musical sound data to the musical sound data playback portion 3 (Step S4) and after that, goes onto operations of Step S5. It should be noted that a relationship between the environmental conditions of the vehicle and the musical sound data is determined beforehand and is stored at a memory or storage which belongs to the musical sound data DB 13 or the control portion 1.

On the other hand, if it is not necessary to change the musical sound data due to a result of detecting the environmental conditions of the vehicle (Step S3: "No"), operations of Step S5 are conducted.

Next, the vehicle status detection portion 11 detects the control status of a vehicle (speed of the vehicle, a revolution of an engine, a degree of opening of an acceleration pedal, an operational status of a brake pedal, an operational status of a shift lever, and the like), and the control portion 1 inputs, recognizes and checks the detection results (Step S5).

Next, the control portion 1 determines whether or not a checking operation of the control status of the vehicle conducted at Step S5 is the first time (Step S6). If the checking operation at Step S5 was not the first time (Step S6: "No"), the control portion 1 determines whether or not there are any changes of the current vehicle status compared to the previous time by checking the control status of the vehicle in reference to the vehicle status included in the relationship table shown in FIG. 3 (Step S7).

If the control portion 1 detects that the checking operation conducted at Step S5 was the first time (Step S6: "Yes") or if the control portion 1 detects that there is a change of the current vehicle status compared to the previous time by checking the control status of the vehicle (Step S7: "Yes"), the control portion 1 determines a playback interval of the musical sound data 20 (Step S8).

Here, details of Step S8 are explained. In accordance with the control status of the vehicle detected at Step S5, the control portion 1 determines the current vehicle status among the statuses shown in FIG. 3 (idling, start, driving at a uniform speed, and the like). In reference to the relationship table stored in the musical sound data DB 13, the control portion 1 determines the position (sampling position) to which the marker corresponding to the vehicle status is set as the playback interval of the musical sound data 20, and sets the position to the musical sound playback portion 3.

Next, the musical sound playback portion 3 starts playing the musical sound data 20 from the first sampling position which is determined at Step S8, and therefore, the speaker 4 outputs the musical sound in accordance with the vehicle status (Step S9).

On the other hand, if the control portion 1 detects that there is no change of the current vehicle status compared to the previous time (Step S7: "No"), the musical sound playback portion 3 continues playing the same marker which has been played at the moment. After that, if the control portion 1 detects a sampling position which is the marker identifying the end position of the sound, the control portion 1 controls the playback portion 3 in order to repeatedly play the sound by going back to the first sampling position of the playback interval of the musical sound data 20 (Step S10). With regard to a case in which no change of the vehicle status is detected for a certain time, it should be noted that an operation of such a case is explained later in a concrete example described below.

Next, the control portion 1 detects whether or not the engine is shut off based on the detection results of the vehicle status detection portion 11 (Step S11). If the engine is not shut off (Step S11: "No"), the control portion 1 goes onto operations of Step S1. If the engine is shut off (Step S11: "Yes"), the control portion 1 controls the musical sound playback portion 3 in order to stop playing the musical sound data 20.

It should be noted that a program which the control portion 1 executes to conduct the above-described operation is stored in a storage or memory portion of the control portion 1 that is not shown in the drawings.

Next, back to FIGS. 2 and 3, a concrete example of operations of the above-described musical sound generating vehicular apparatus is explained. First, if the engine of the vehicle is idled, the musical sound data corresponding to an interval of the marker (idling) 21 (sampling position from 0 to 100) is played. Next, if the vehicle starts running, the musical sound data corresponding to an interval of the marker (start) 22 (sampling position from 120 to 150) is played.

Next, if the vehicle is accelerated, the musical sound data corresponding to an interval of the marker (acceleration 1) 23 (sampling position from 260 to 310) is played. Moreover, if the vehicle is accelerated at another acceleration, the musical sound data corresponding to an interval of the marker (acceleration 2) 24 (sampling position from 350 to 400) is played.

Next, if the vehicle is running at a uniform speed, the musical sound data corresponding to an interval of the marker (driving at uniform speed) 28 (sampling position from 160 to 250) is played. After that, if a predetermined time has passed while the vehicle has been running at a uniform speed, the musical sound data corresponding to the interval of the marker (driving at uniform speed) 28 is played until a position of the end (sampling position 250).

In such a case, the control portion 1 controls the musical sound playback portion 3 so as to play the musical sound data after going back to the first sampling position (sampling position 160) of the playback interval corresponding to the marker 28 of the musical sound data 20. If the vehicle keeps running at the uniform speed, the control portion 1 repeats the above-described playback operations for predetermined times by controlling the musical sound playback portion 3 so as to repeatedly playback the musical sound data 20 corresponding to the marker (driving at the uniform speed) 28.

Moreover, if the control portion 1 detects that the vehicle has been running at the uniform speed for the predetermined time and the musical sound data corresponding to the marker 28 has been repeated for the predetermined times, the control portion 1 controls the musical sound playback portion 3 so as to play the musical sound data 20 until a position of the repeat marker 32 (sampling position 390). If the musical sound data 20 is played until the repeat marker 32, the control portion 1 controls the musical sound playback portion 3 so as to play the musical sound data 20 after going back to the first sampling position of the playback interval corresponding to the marker 28 of the musical sound data 20.

In other words, if the control status of the vehicle has not been changed while the musical sound data has been played until the end position of the marker, the control portion 1 controls the musical sound playback portion 3 to repeat the musical sound data of the playback interval corresponding to the marker for the predetermined time.

Moreover, if the control portion 1 detects that the control status of the vehicle has not been changed for the predetermined time, the control portion 1 changes the position of the playback interval and controls the musical sound playback portion 3 to repeat the musical data.

It should be noted that there are various methods of changing the playback interval of the musical sound data other than the above-described steps. For example, it is possible to switch to another marker (such as the marker 29 shown in FIG. 3).

Furthermore, if the control portion 1 detects that the vehicle has been running at the uniform speed after the above-described operations, the control portion 1 controls the musical sound playback portion 3 to play the musical sound data 20 until the end of the data. After that, the control portion 1 selects musical sound data including other content that is not shown in the drawings, and controls the musical sound playback portion 3 to play a marker (driving at the uniform speed) of the selected musical sound data. If the control portion detects that the vehicle status is changed after running at the uniform speed, the control portion 1 controls the musical sound playback portion 3 to play appropriate markers of the selected musical sound data.

It should be noted that the above-described operations conducted while the vehicle is running at the uniform speed can be applied to other vehicle statuses (for example, idling).

On the other hand, in FIGS. 2 and 3, if the vehicle is decelerated, a position of the musical sound data 20 corresponding to the marker (deceleration 1) 25 (sampling position from 440 to 500) is played. Moreover, if the vehicle is decelerated at a different deceleration, the musical sound data corresponding to the marker (deceleration 2) 26 (sampling position from 520 to 600) is played.

Moreover, if the vehicle stops, the musical sound data corresponding to the marker (stop) 27 (sampling position from 620 to 690) is played.

Moreover, in a case in which the control portion 1 detects that, based on the detection results of the vehicle status detection portion 11, a headlight is turned on, the engine is started and the vehicle starts running after parking the vehicle and shutting off the engine, and the like, the control portion 1 selects other musical sound data including different content from the musical sound DB 13 and controls the musical sound playback portion 3 to play the selected musical sound data.

Moreover, in a case in which the control portion 1 detects that, based on the position information obtained by the environmental condition detection portion 12, the vehicle is running into another area (such as a neighboring prefecture), the vehicle runs into a highway from an ordinary road, and the like, the control portion 1 selects other musical sound data including different content from the musical sound DB 13 and controls the musical sound playback portion 3 to play the selected musical sound data.

That is, in accordance with the environmental condition and/or the control status of the vehicle, the control portion 1 selects the musical sound data which is played by the musical sound playback portion 3 from the musical sound data DB 13. Markers are already set with regard to the selected musical sound data. Therefore, the control portion 1 controls the musical sound playback portion 3 so as to play the selected musical sound data corresponding to a playback interval in accordance with the control status and the environmental condition of the vehicle.

As described above, by using the musical sound generating vehicular apparatus of this embodiment, it is possible to automatically play the appropriate musical sounds in accordance with the control status and the environmental condition of the vehicle. Therefore, it is possible to create and provide a new aspect of feeling which is amusing and enjoyable by generating the musical sounds while driving the vehicle without making the driver and passengers bored.

Moreover, in accordance with the above-described embodiment, the control status and the environmental status of the vehicle are continuously expressed by playing the musical sounds which have variation and changes. Therefore, it is possible to understand driving conditions and status of the vehicle anytime.

Furthermore, the musical sounds generated by the musical sound generating vehicular apparatus are enjoyable. Therefore, it is possible to provide a better feeling while driving, it is possible to provide various types of additional information with the musical sounds to the driver and the passengers, and it is possible to comfortably drive the vehicle.

In addition, the musical sound is automatically changed even if there is no change in the control status and the environmental status of the vehicle. Therefore, it is possible to prevent the driver and the passengers from being bored while listening to the musical sounds.

The first embodiment which is an example of the present invention is explained above. However, it should be noted that the present invention is not limited by the above-described embodiment. It is possible to apply changes such as addition, omission and replacement of the constitutional elements if it is not out of a scope of the present invention.

For example, number and positions of the markers, the vehicle status to which the marker corresponds, and the like are not limited by the above-described example. Moreover, it is possible to use multiple markers which are partially or completely overlapping the same position of the musical sound data.

Furthermore, number and positions of the repeat markers are not limited by the above-described example.

In addition, the repeat marker is not always necessary. Even in a case in which the repeat marker is not used, if the vehicle status has not been changed even after repeating the playback interval corresponding to the marker for the predetermined time, it is possible to stop playing the musical sound data.

Second Embodiment

Figure 5:
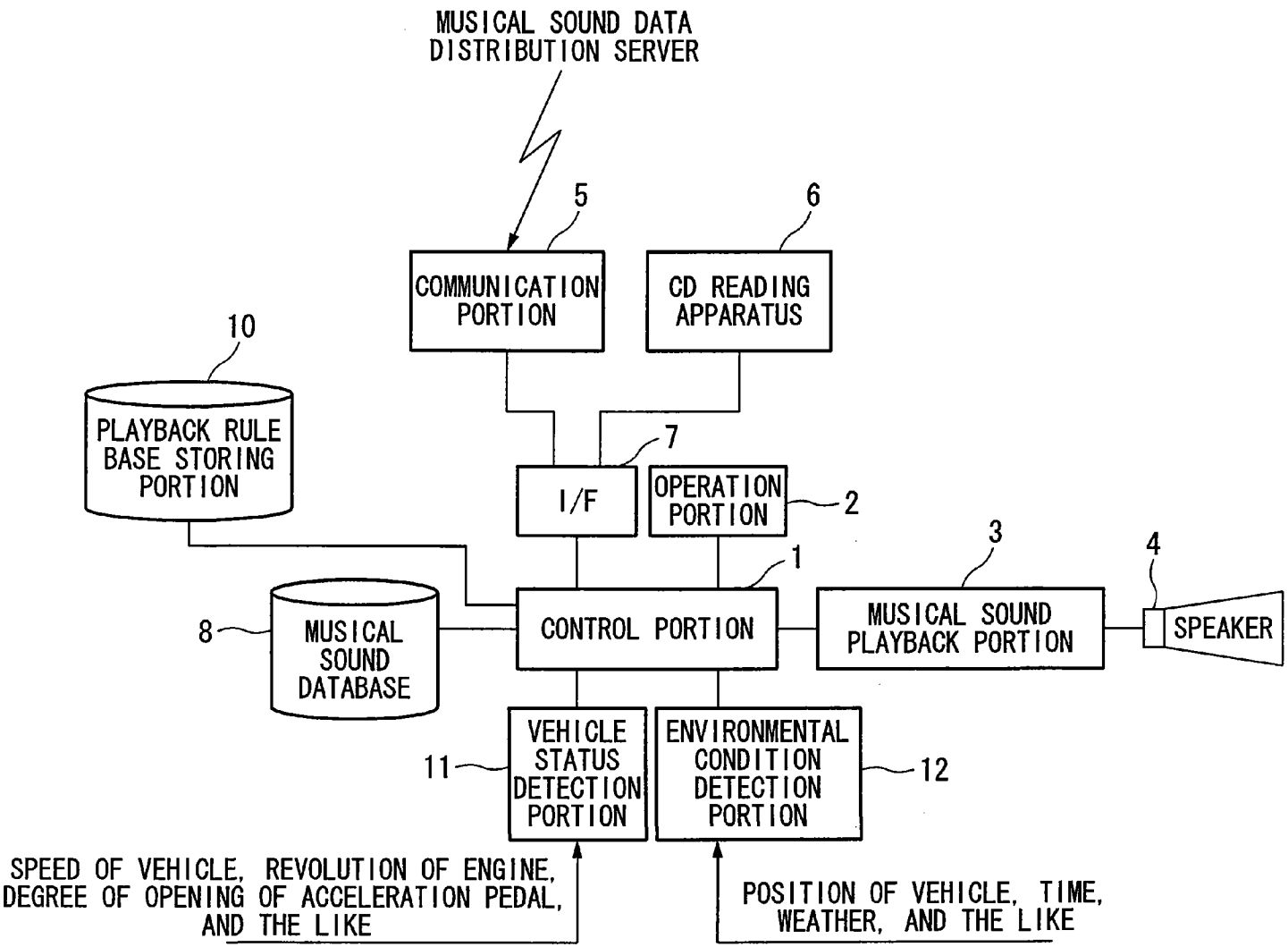
FIG. 5 is a block diagram which shows a constitution of a second embodiment.

Hereinafter, in reference to the drawings, a musical sound generating vehicular apparatus of the Second embodiment is explained. It should be noted that, in the following explanations, the same reference numerals are assigned to constitutional elements of this embodiment if the constitutional elements are the same as or similar to the above-described First embodiment. FIG. 5 is a block diagram showing a constitution of the musical sound generating vehicular apparatus of the Second embodiment. In FIG. 5, a reference numeral 1 is a control portion which integrally controls operations of the musical sound generating vehicular apparatus. A reference numeral 2 is an operation portion used for operations of setting of the musical sound generating vehicular apparatus, obtaining new musical sound data, and the like by the user. The operation portion 2 provides a display apparatus, and the user sees the display portion while operating if necessary. A reference numeral 3 is a musical sound playback portion which plays the musical sounds based on the musical sound data, and the musical sound is outputted by a speaker 4. It is possible to use an audio system installed in a vehicle instead of the musical sound playback portion 3 and the speaker 4. A reference numeral 5 is a communication portion for connecting to and communicating with a musical sound distribution server, and the like via a mobile communication network in order to obtain the musical sound data. A reference numeral 6 is a CD (compact disc) reading apparatus for reading the musical sound data recorded on a CD. It is possible to use an audio system installed in a vehicle instead of the CD reading apparatus 6. A reference numeral 7 is an interface (hereinafter, I/F) for connecting the communication portion 5 and the CD reading apparatus 6 to the control portion 1.

A reference numeral 8 is a musical sound database which stores the musical sound data that is played by the musical sound playback portion 3. A reference numeral 10 is a playback rule base storing portion which stores playback rule information that is used for selecting a phrase to be played based on driving status of the vehicle and environmental conditions surrounding the vehicle. Here, the phrase is the musical sound data corresponding to a portion of a melody that is obtained by dividing musical sound data of the whole melody into short intervals in a naturally acceptable manner. A reference numeral 1 is a vehicle status detection portion detects the control status of a vehicle (speed of the vehicle, a revolution of an engine, a degree of opening of an acceleration pedal, an operational status of a brake pedal, an operational status of a shift lever, and the like), and is constituted from, for example, a sensor. With regard to the vehicle status detection portion 11, instead of newly providing a sensor, it is possible to apply outputs from sensors which are already installed in the vehicle for controlling.

A reference numeral 12 is an environmental condition detection portion which detects environmental conditions around the vehicle (a position of the vehicle, time, weather, and the like) and is constituted from, for example, a GPS, a timer, a sensor, and the like.

Here, terms used in the following explanations are defined. "Pitch" means a tone of sound, and pitch is expressed in a manner such as "pitch is high" and "pitch is low". "Volume" means a volume (strength) of sound, and volume is expressed in a manner such as "volume is large" and "volume is small". "Tempo" means a speed of playing music, and tempo is expressed in a manner such as "tempo is fast" and "tempo is slow". "Timbre" means characteristics of sounds, and timbre is expressed, for example, by using a degree of voice signal which is included in a predetermined frequency band based on results of spectrum analysis of the sounds.

Here, "pitch", "volume", "tempo" and "timbre" are called musical parameters, and each of the musical sound parameters is expressed by using levels 1-3. Level 1 means that the parameter has a large value, and level 3 means that the parameter has a small value. Level 2 means an intermediate value between levels 1 and 3. For example, with regard to pitch, level 1 is a tone which is higher than a first threshold, level 3 is a tone which is lower than a second threshold, and level 2 is a tone between the first threshold and the second threshold.

Figure 7:
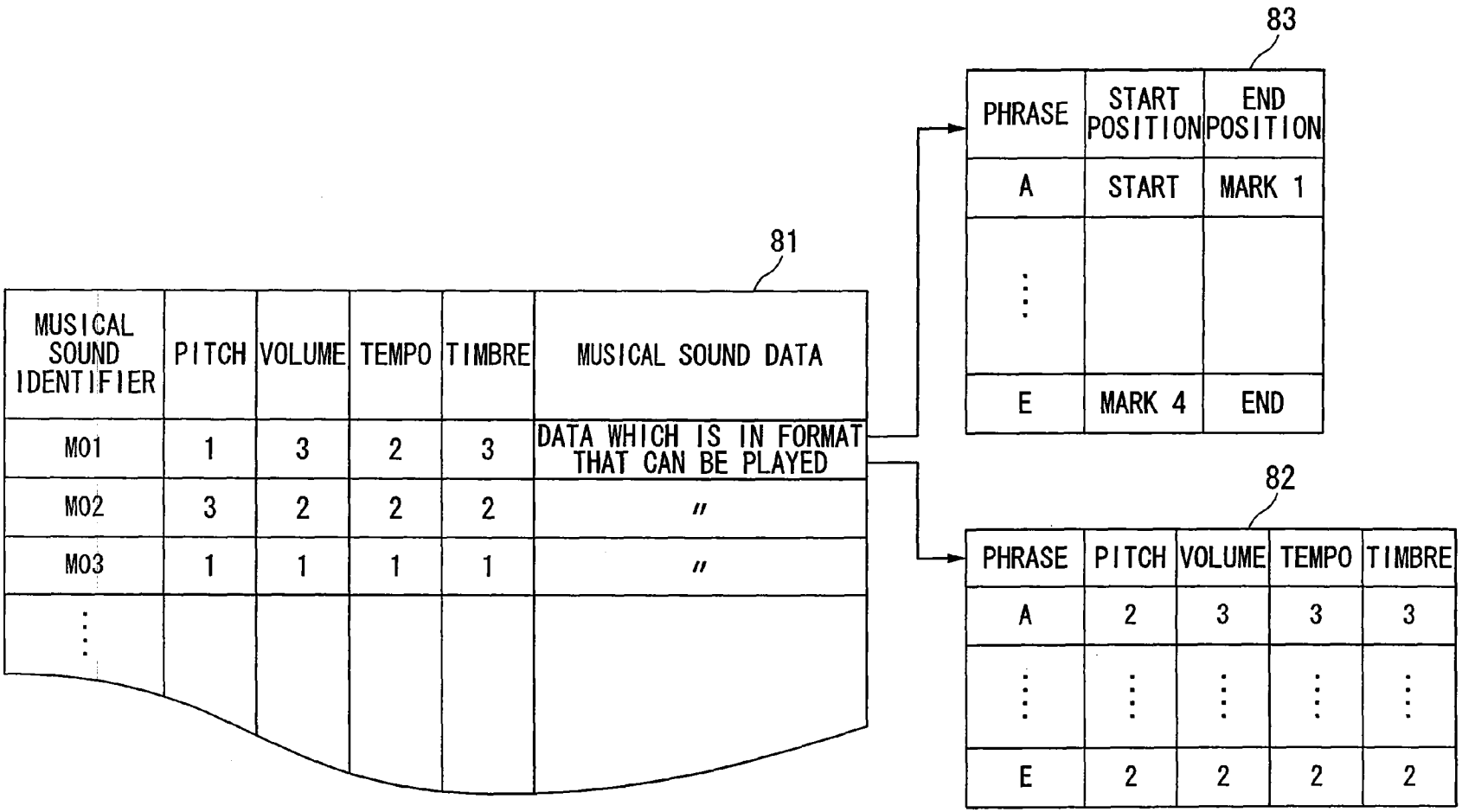
FIG. 7 is a drawing for explaining a table constitution of a musical sound database shown in FIG. 5.

Next, in reference to FIG. 7, a table structure of the musical sound database 8 shown in FIG. 5 is explained. The musical sound database 8 includes: a musical sound data table 81 for storing the musical sound data; a phrase characteristics table 82 for defining characteristics of multiple phrases (pitch, volume, tempo, timbre) included in the musical sound data; and a phrase position table 83 for defining a start position and an end position of each of the multiple phrases included in the musical sound data. In the musical sound data table 81, a musical sound identifier is assigned to the musical sound data which is constituted in a format that can be played by the musical sound playback portion 3. The musical sound data table 81 includes four musical element parameters which define overall characteristics of the musical sound data. For example, with regard to the musical sound data to which a musical sound identifier "MO1" is assigned, the musical sound data table 81 shows that an average pitch from start to end of the musical sound is level 1, an average volume is level 3, an average tempo is level 2, and an average timbre is level 3. That is, the musical sound data table 81 shows that the musical sound of "MO1" has overall characteristics in which tone is low, tempo is intermediate, and volume is large. Moreover, level of timbre is determined by a degree of voice signal which is included in a predetermined frequency band, and can indirectly indicate types of musical instruments which are used for playing the musical sound.

The phrase characteristics table 82 shows that the musical sound of "MO1" is divided into five phrases A-E and the musical element parameters of each of five phrases are defined. For example, with regard to the phrase A, the phrase characteristics table 82 shows that an average pitch of the phrase A is level 2, an average volume is level 3, an average tempo is level 3, and an average timbre is level 3. FIG. 7 does not show, but with regard to the musical sound "MO2" and "MO3", there are tables defined and linked in the same manner as the phrase characteristics table 82.

In the phrase position table 83, a position of each of the phrases A-E is shown by defining a start position and an end position on the musical sound of "MO1". For example, the phase position table 83 shows that the phrase A is from the top of the musical sound to a mark 1, and the phase E is from a mark 4 to the end of the musical sound. A marking operation in which the marks are assigned on the musical sound data is explained later.

Next, in reference to FIGS. 8 and 9, a table structure of the playback rule base storing portion 10 shown in FIG. 5 is explained. The playback rule base storing portion 10 is constituted from a musical sound selection rule table 101 and a phrase selection rule table 102. First, in reference to FIG. 8, the musical sound selection rule table 101 is explained. In the musical sound selection rule table 101, the musical element parameters are defined beforehand which show characteristics of the musical sound to be played in accordance with the environmental condition. The environmental condition is defined with respect to combinations of weather information (fine, cloudy and rainy) and time information (AM, PM) which are prepared to information of locations (seaside, mountainous area, midtown, and the like). In the musical sound selection rule table 101, for example, in a case in which the vehicle is parked or driving along the seaside, time is AM and weather is fine, it is defined that the musical sound data is selected and played which has a pitch of level 2, volume of level 2, tempo of level 3 and timbre of level 2.

In the phrase selection rule table 102 shown in FIG. 9, with respect to each driving status of the vehicle (idling, start, driving at the uniform speed, acceleration, deceleration, . . . , and the like), the music element parameters indicating characteristics of the phrase to be played are defined beforehand. Here, each driving status is defined in accordance with a predetermined rule based on a vehicle speed, revolution of the engine, operational status of various functions, and the like. For example, in the phrase selection rule table 102, in a case in which the driving status is idling, it is defined that the phrase is selected and played which has a pitch of level 1, volume of level 2, tempo of level 1 and timbre of level 2.

Next, operations of the musical sound generating vehicular apparatus shown in FIG. 5 are explained. First, operations of obtaining new musical sound data are explained. The user inputs commands to prepare for obtaining or storing the new musical sound data by using the operation portion 2. Next, the user inserts a music CD into the CD reading apparatus 6 and inputs commands to read and store the musical sound data. The CD reading apparatus 6 reads the musical sound data recorded in the inserted CD and outputs the musical sound data to the control portion 1 via the I/F 7. The control portion 1 inputs the musical sound data outputted from the CD reading apparatus 6 and analyzes the musical sound data in order to obtain the musical element parameters (pitch, volume, tempo and timbre) with regard to the overall musical sound data. The control portion 1 generates and assigns a unique musical sound identifier to the musical sound data and stores the musical sound identifier, the musical element parameters and the musical sound data in the musical sound data table 81. If the musical sound identifier can be read from the inserted CD, it is possible to use the read musical sound identifier.

On the other hand, in a case of obtaining or storing new musical sound data from the musical sound distribution server via a network, the user inputs commands via the operation portion 2 to obtain the new musical sound data from the musical sound data distribution server. In accordance with the user's command, the communication portion 5 connects to the predetermined musical sound distribution server and downloads the musical sound data which is requested by the user. The communication portion 5 outputs the downloaded musical sound data to the control portion 1 via the I/F 7. The control portion 1 inputs the musical sound data outputted from the communication portion 5 and analyzes the musical sound data in order to obtain the musical element parameters (pitch, volume, tempo and timbre) with regard to the overall musical sound data. The control portion 1 stores the musical sound identifier which is assigned to the musical sound data beforehand, the musical element parameters and the musical sound data in the musical sound data table 81. In accordance with the above-described operations, the new musical sound data is stored in the musical sound database 8. It should be noted that a format of the musical sound data and information for determining a genre of the musical sound is included in a header portion of the musical sound data which is recorded in a musical sound data field of the musical sound data table 81.

Figure 6:
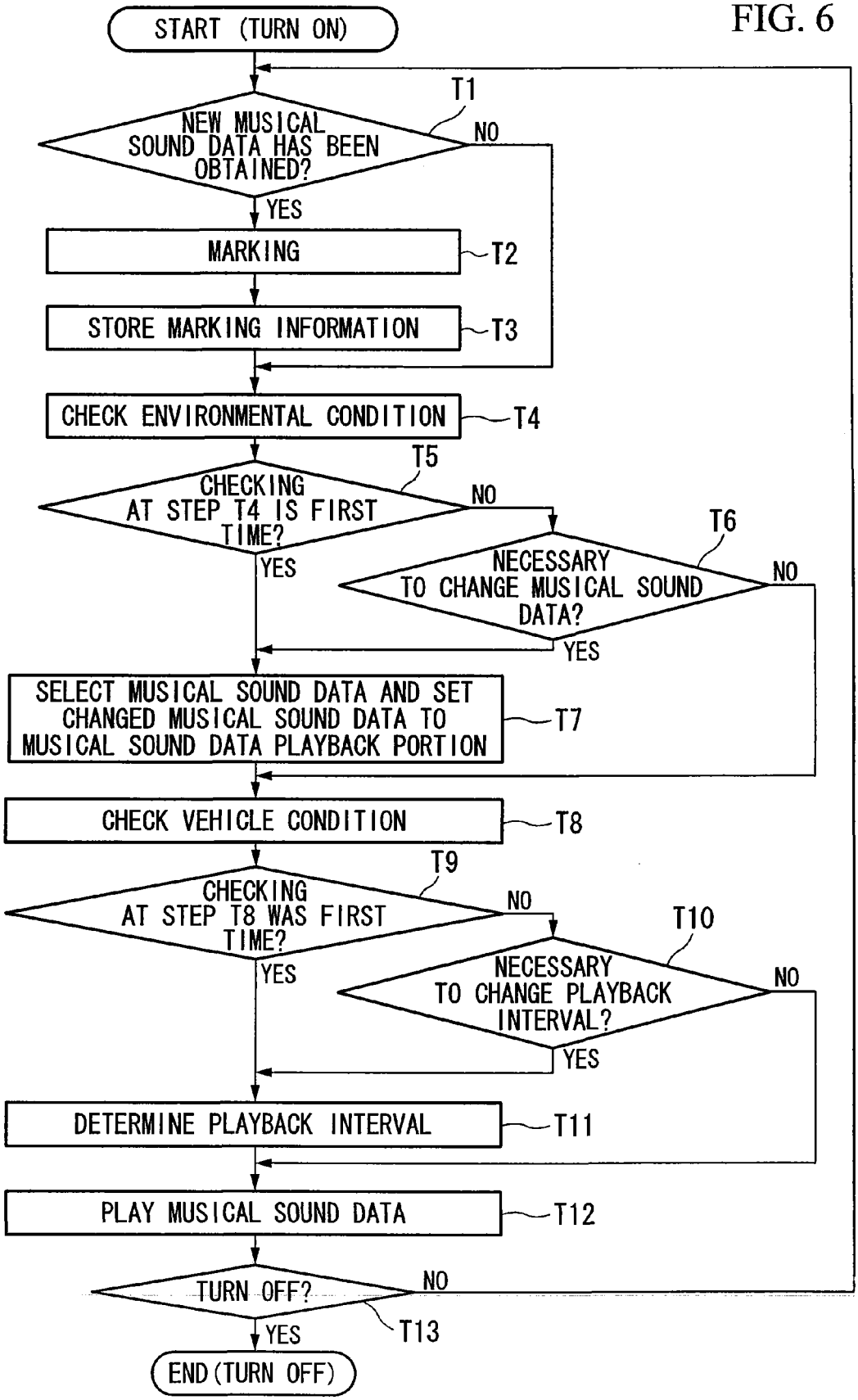
FIG. 6 is a flowchart which shows operations of an apparatus shown in FIG. 5.

Next, in reference to FIG. 6, with regard to the musical sound generating vehicular apparatus shown in FIG. 5, an operation of assigning marks to the musical sound data and an operation of playing phrases which are appropriate to the driving status are explained. First, when the musical sound generating vehicular apparatus is turned on, the control portion 1 refers to the musical sound database 8 in order to detect whether or not new musical sound data has been obtained (whether or not there is the musical sound data to which no marks is assigned) (Step T1). If the control portion 1 detects that there is the new musical sound data, a marking operation is conducted (Step T2). If the control portion 1 does not detect the new musical sound data, operations of Step T4 are conducted. When the control portion conducts the marking operation, first, the control portion 1 reads the musical sound data from the musical sound data table 81 and extracts musical sound genre information included in the musical sound data.

Figure 10:
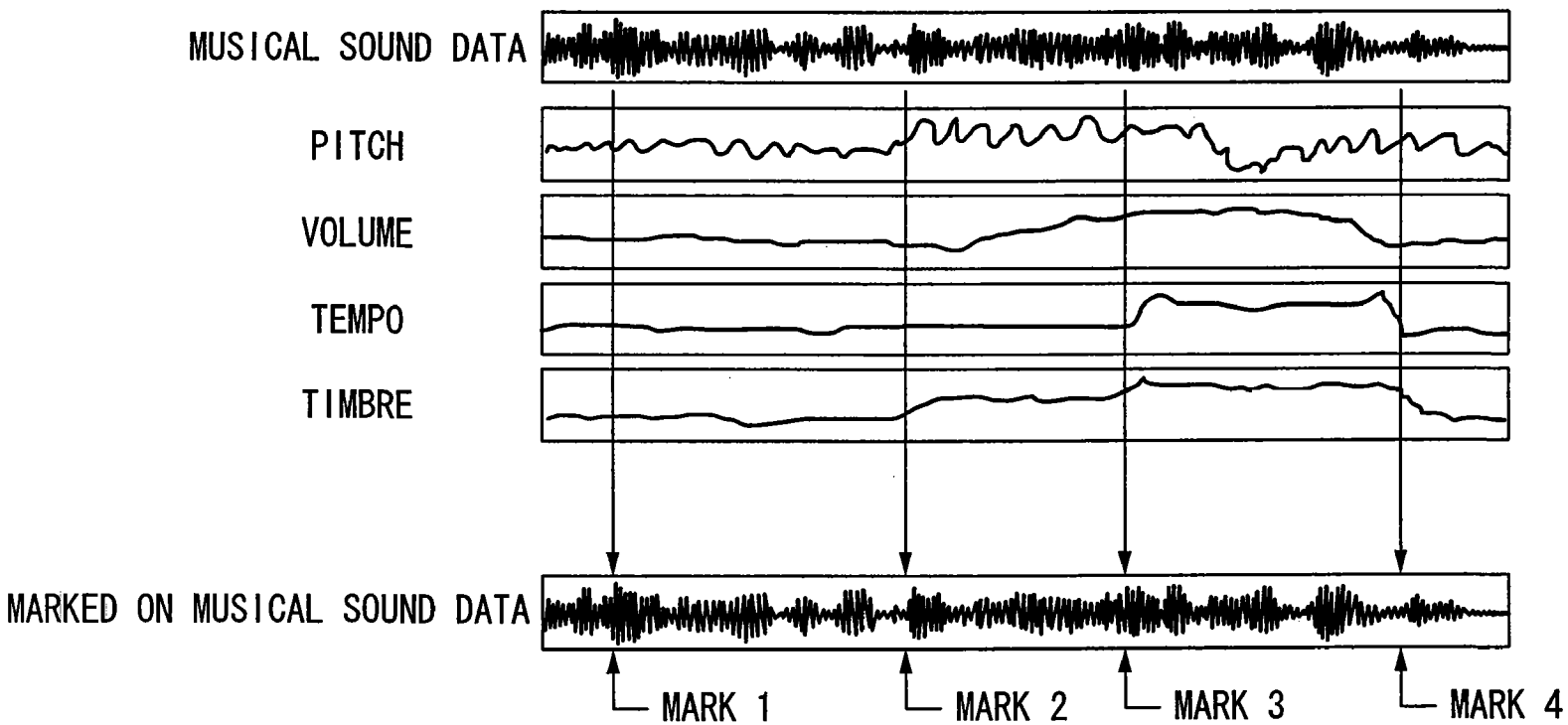
FIG. 10 is a drawing for explaining an example of marking musical sound data.

Next, the control portion 1 reads the musical sound data from the musical sound database 8 and maintains for a while. The control portion 1 extracts the musical element parameters from the maintained musical sound data. After that, the control portion 1 conducts the marking operation based on four musical element parameters of the musical sound data that have been read. FIG. 10 is a drawing which shows one example of the musical sound data read from the musical sound database 8. The control portion 1 analyzes four musical element parameters including pitch, volume, tempo and timbre and determines positions of the marks based on the predetermined thresholds. For example, in FIG. 10, the control portion 1 obtains marking positions of marks 1-4 (therefore, there are five phrases) by comparing rate of change of pitch, rate of change of volume, and the like to the predetermined thresholds. Moreover, when the above-described marking operation is conducted, it is possible to apply weights to the parameters of four musical elements and determine the marking positions based on the weights. For example, with regard to the marks 1-4 shown in FIG. 10, by comparing the parameters to the thresholds after applying the weight to volume with regard to the mark 1, by comparing the parameters to the thresholds after applying the weight to tempo with regard to the mark 4, and the like, it is possible to improve accuracy of marking positions that are assumed beforehand in accordance with the genre of the musical sound. In accordance with such a method, for example, it is possible to divide the musical sound data into phrases which have characteristics such as a soft phrase, an uprising phrase and a phrase including a certain instrument.

Next, the control portion 1 stores calculated and obtained positions to be marked in the phrase position table 83. Information of the marks is defined by, for example, playback time from the top of the musical sound. By using such information, it is possible to store the marking position which indicates a boundary of each of the phrases in the phrase position table 83 shown in FIG. 7. Next, after dividing the musical sound into multiple phrases, the control portion 1 analyzes four musical element parameters with regard to each of the multiple phrases in order to obtain levels of four parameters and stores the obtained levels of four parameters in the phrase characteristics table 82 (Step T3). In accordance with an operation, the musical element parameters which indicate characteristics of the phrases are stored in the phrase characteristics table 82 shown in FIG. 7. It should be noted that it is not necessary to conduct operations of Steps T2 and T3 (marking operation) shown in FIG. 6 at the time when the playback operation of the musical sound is conducted, that is, it is possible to conduct operations of Steps T2 and T3 while the musical sound playback portion 3 is not playing the musical sound.

On the other hand, if the engine is started, the control portion 1 reads the environmental conditions (position of the vehicle, time, weather, and the like) around the vehicle detected by the environmental condition detection portion 12 and checks the detection results (Step T4). Next, the control portion 1 determines whether or not checking operation of the environmental conditions at Step T4 is the first time (Step T5). If the checking operation at Step T4 was not the first time of checking (Step T5: "No"), the control portion 1 determines whether or not it is necessary to change the musical sound data (Step T6).

If the control portion 1 detects that the checking operation conducted at Step T4 was the first time (Step T5: "Yes"), or if the control portion 1 detects that there is a change of the current environmental conditions compared to the previous time and it is necessary to change the musical sound data (Step T6: "Yes"), the control portion 1 determines the most appropriate musical sound data from the musical sound database 8 based on the detected environmental conditions around the vehicle, notifies the selected musical sound data to the musical sound playback portion 3 (Step T7) and conducts operations of Step T8. With regard to the operation of selecting the most appropriate musical sound data, first, the control portion 1 reads four parameters corresponding to information of the detected position of the vehicle, weather and time in reference to the musical sound selection table 101 shown in FIG. 8. Next, in reference to the musical sound data table 81, the control portion 1 selects the musical sound which has the musical element parameters which have the same values or the most approximate values compared to the musical element parameters read from the musical sound selection rule table 101. In accordance with such an operation, it is possible to select the musical sound which is the most appropriate to the environmental conditions of the vehicle.

On the other hand, after checking the environmental conditions of the vehicle, if the control portion 1 detects that it is not necessary to change the musical sound data (Step T6: "No"), the control portion 1 conducts operations of Step T8.

Next, the vehicle status detection portion 11 detects the driving status of a vehicle (speed of the vehicle, a revolution of an engine, a degree of opening of an acceleration pedal, an operational status of a brake pedal, an operational status of a shift lever, and the like), and the control portion 1 inputs and checks the detection results (Step T8). Next, the control portion 1 determines whether or not the checking operation of the driving status of the vehicle conducted at Step T8 is the first time (Step T9). If the checking operation at Step T8 was not the first time (Step T9: "No"), the control portion 1 determines whether or not there are any changes of the current vehicle status compared to the adjacent status by checking the driving status of the vehicle, that is, whether or not it is necessary to change the phrase to be played (Step T10).

If the control portion 1 detects that the checking operation conducted at Step T8 was the first time (Step T9: "Yes") or if the control portion 1 detects that there is a change of the current driving status compared to the previous time (Step T10: "Yes"), the control portion 1 determines the phrase to be played (Step T11). With regard to the operation of selecting the phrase to be played, first, the control portion 1 reads four parameters corresponding to the driving status of the vehicle in reference to the phrase selection table 102 shown in FIG. 9. Next, in reference to the phrase characteristics table 82, the control portion 1 selects the phrase which has the musical element parameters which have the same values or the most approximate values compared to the musical element parameters read from the phrase selection rule table 102. In accordance with such an operation, it is possible to select the phrase which is the most appropriate to the driving status of the vehicle.

Next, the control portion 1 reads the start position and the end position of the phrase to be played which was selected in the above-described operations from the phrase position table 83. Based on information of the start position and the end position, the control portion 1 reads phrase data corresponding to the phrase to be played from the musical sound data table 81 and outputs the phrase data to the musical sound playback portion 3. The musical sound playback portion 3 inputs and plays the phrase data outputted from the control portion 1, and the speaker 4 generates the musical sound (phrase) which is appropriate to the driving status of the vehicle (Step T12).

On the other hand, if the control portion 1 detects that there is no change of the current driving status of the vehicle compared to the previous time (Step S10: "No"), the musical sound playback portion 3 continues the playing operation based on the same phrase which has been played at the moment. After that, in a case of reaching the end position of the phrase, the playback portion 3 repeatedly plays the phrase outputted from the control portion 1.

Next, the control portion 1 determines whether or not power of the musical sound generating vehicular apparatus is off (Step T13). If the control portion 1 detects that the power is not off (Step T13: "No"), the control portion 1 conducts the operation of Step T1. If the control portion 1 detects that the power is off (Step T13: "Yes"), the control portion 1 controls the musical sound playback portion 3 so as to stop playing.

It should be noted that a program which is executed by the control portion 1 for conducting the above-described operations is stored in a memory or storage of the control portion 1 that is not shown in the drawings.

In the above-described embodiment, if the driving status of the vehicle has not been changed for the predetermined time, the phrase data which is selected is repeated. However, after that, if the control portion 1 detects that the driving status has not been changed after the predetermined time again, it is possible to newly select another phrase in order to prevent the same phrase from being repeated. Moreover, it is possible to newly select other musical sound data again and select the phrase data again. Otherwise, when the driving status of the vehicle is in a state of initial driving operations, for example, idling and starting after turning on the engine, it is possible to select the first phrase (for example, introduction) of the musical sound. Moreover, when the driving status of the vehicle is in a state of the end of driving, for example, deceleration, stopping, and parking, it is possible to select the last phrase (for example, ending) of the musical sound.

Moreover, in addition to the driving statuses of the vehicle stored in the phrase selection rule table 102 as shown in FIG. 9, it is possible to store the musical element parameters which indicate characteristics of phrases that are played in accordance with events such as turning on the headlight, operating the winker, operating the wiper, and the like.

It is possible to obtain the musical sound data from a music CD generally sold on the market, and it is possible to obtain the musical sound data by obtaining a set of musical sound data including various phrases dedicated to the musical sound generating vehicular apparatus of the above-described embodiments. Moreover, data format of the musical sound data can be, for example, sequence data of MIDI format or audio data.

In the above-described embodiment, the musical element parameters of the musical sound data are analyzed and stored as information that indicates characteristics of the musical sound data, the musical sound data is divided into multiple phrases, the musical element parameters of the divided phrases are analyzed and stored as information that indicates characteristics of the phrase data, the appropriate musical sound data is selected in accordance with the environmental conditions of the vehicle, and the appropriate phrase is selected in accordance with the driving status of the vehicle. Therefore, it is possible to achieve an automatic playback operation in which the musical sound is changed in accordance with the driving status and the environmental conditions of the vehicle. Moreover, in accordance with the above-described embodiment, it is not necessary to create or prepare data for playback beforehand, and it is possible to achieve an automatic playback operation in which the musical sound is selected by using the musical sound data which the user already has in accordance with the driving status and the environmental conditions of the vehicle. Furthermore, for example, it is possible to select and play an uprising phrase of the musical sound data when the driver pushes the acceleration pedal in order to accelerate and select and play a soft phrase when the vehicle is running at a uniform speed.

Therefore, it is possible to create and provide a new aspect of feeling which is amusing and enjoyable by generating the musical sounds while driving the vehicle without making the driver and passengers bored. Moreover, in accordance with the above-described embodiment, the driving status of the vehicle is continuously expressed by playing the musical sounds which have variation and changes. Therefore, it is possible to understand driving conditions and status of the vehicle anytime.

Furthermore, the musical sounds generated by the musical sound generating vehicular apparatus are enjoyable. Therefore, it is possible to provide better feelings while driving, it is possible to provide various types of additional information with the musical sounds to the driver and the passengers, and it is possible to comfortably drive the vehicle. In addition, the musical sound is automatically changed even if there is no change in the driving status of the vehicle. Therefore, it is possible to prevent the driver and the passengers from being bored while listening to the musical sounds.

It should be noted that the present invention is not limited to the above description. For example, following changes and modifications can be applied.

First, it is preferable to apply the present invention not only to the musical sound data, but also to image data, movie data, and the like.

Second, the present invention is not limited to musical sounds, and it is possible to use vocal sounds, natural sounds, and the like. Moreover, it is possible to combine such sounds.

Third, other than a single song, for example, it is possible to play multiple songs (musical sound data) at the same time. Moreover, it is possible to play the musical sound data while playing and synchronizing image data, movie data, or the like.

Fourth, it is possible to obtain the musical sound data which is not only recorded on a CD or received via the network, but also recorded or stored on an MD (mini disc), DVD (digital versatile disc), USB memory card, a cellular phone, and the like that are obtained via an interface such as USB. Also, it is possible to obtain musical sound data stored on one's home PC or recorded on a DVD via the Internet, or the like. Moreover, it is possible to obtain the musical sound data by receiving broadcasted air waves such as television and radio.

Fifth, it is possible for the above-described vehicle to be a motorcycle, train, bicycle, or the like. Moreover, it is possible to apply the present invention not only to the vehicle, but also to a powerboat, jet-ski, snowmobile, or the like.

Sixth, it is possible to use a personal computer, or the like to set the markers or the marks.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A musical sound generating apparatus for a vehicle, comprising:

a vehicle state detection unit that detects a control state among a plurality of predetermined control states of a vehicle;

a storage unit that stores at least one musical sound data containing a plurality of predetermined markers each associated with one of the predetermined control states;

a musical sound playback unit that plays the musical sound data stored in the storage unit; and a control unit that selects one of the predetermined markers associated with the control state of the vehicle detected by the vehicle state detecting unit, and controls the musical sound playback unit to play a segment of the musical sound data corresponding to the selected predetermined marker, wherein the segment of the musical sound data corresponding to each of the predetermined markers has an associated playback duration.

2. A musical sound generating apparatus according to claim 1, wherein the storage unit stores a plurality of musical sound data, and the control unit selects one of the plurality of musical sound data to be played by the musical sound playback unit from the storage unit.

3. A musical sound generating apparatus according to claim 2, further comprising an environmental condition detection unit that detects environmental condition of the vehicle, wherein the control unit selects one of the plurality of the musical sound data to be played by the musical sound playback unit from the storage unit based on the detected control environmental condition of the vehicle.

4. A musical sound generating apparatus according to claim 1, wherein if the detected control state of the vehicle has not been changed for a predetermined time, the control unit controls the musical sound playback unit to repeat the segment of the musical sound data for the associated playback duration.

5. A musical sound generating apparatus according to claim 1, wherein if the detected control state of the vehicle has not been changed after a predetermined time, the control unit selects another predetermined marker to play another segment of the musical sound data corresponding to the another predetermined marker for an associated playback duration corresponding to the another predetermined marker, and controls the musical sound playback unit to repeat the another segment of the musical sound data if the detected control state has not changed for another predetermined time.

6. A musical sound generating apparatus according to claim 1, further comprising:

a playback position detection unit that determines the associated playback duration of each segment of the musical sound data corresponding to one of the predetermined markers based on a predetermined musical element parameter of the musical sound data;

an analysis unit that analyzes and stores the predetermined musical element parameter of the associated playback duration in the storage unit together with a connection relationship with regard to the musical sound data; and a playback rule data storage unit that stores the predetermined musical element parameter of the musical sound to be played together in association with a corresponding-control state of the vehicle, wherein the control unit obtains the musical element parameter corresponding to the control state of the vehicle detected by the vehicle state detection unit in reference to the playback rule data storage unit, determines the associated playback duration of the musical sound data that satisfies conditions of the obtained musical element parameter, and controls the musical sound data playback portion to play the associated playback duration of the musical sound data.

7. A musical sound generating apparatus according to claim 6, further comprising an environmental condition detection unit that detects an environmental condition of the vehicle, wherein the storage unit stores a plurality of musical sound data, and wherein the control unit selects one of the plurality of the musical sound data to be played by the musical sound playback unit from the storage unit based on the environmental condition of the vehicle detected by the environmental condition detection unit.

8. A musical sound generating apparatus according to claim 6, wherein the musical element parameter is at least one of pitch, volume, tempo, or timbre.

9. A musical sound generating method for a vehicle comprising the steps of:

detecting a control state among a plurality of predetermined control states of a vehicle;

storing at least one musical sound data containing predetermined markers each associated with one of the predetermined control states in a storage unit;

selecting one of the predetermined markers associated with the control state detected in the detecting step; and playing a segment of the musical sound data corresponding to the selected predetermined marker, wherein the segment of the musical sound data corresponding to each of the predetermined markers has an associated playback duration.

10. A computer-readable medium storing a computer program for controlling a musical sound generating apparatus for a vehicle, the computer program comprising computer executable instructions for:

detecting a control state among a plurality of predetermined control states of a vehicle;

storing at least one musical sound data containing predetermined markers each associated with one of the predetermined control states in a storage unit;

selecting one of the predetermined markers associated with the control state detected in the detecting instruction; and playing a segment of the musical sound data corresponding to the selected predetermined marker, wherein the segment of the musical sound data corresponding to each of the predetermined markers has an associated playback duration.

* * * * *